United States Patent [19]

Beck et al.

[11] 4,150,482

[45] Apr. 24, 1979

[54] MODULAR CUTTER ASSEMBLY FOR AN ELECTRIC DRY SHAVER

[75] Inventors: William P. Beck, Westchester; Francis L. Carr, Downers Grove, both of Ill.

[73] Assignee: Sunbeam Corporation, Chicago, Ill.

[21] Appl. No.: 851,152

[22] Filed: Nov. 14, 1977

[51] Int. Cl.[2] ..... B26B 19/04

[52] U.S. Cl. ..... 30/43.9; 30/346.51

[58] Field of Search ..... 30/43.4–43.92, 30/346.51

[56] References Cited

U.S. PATENT DOCUMENTS

| | | | |
|---|---|---|---|
| 2,331,500 | 10/1943 | Rand | 30/43.9 |
| 3,218,707 | 11/1965 | Schell | 30/43.9 |
| 4,012,837 | 3/1977 | Ascoli | 30/346.51 |

*Primary Examiner*—Robert C. Watson

*Attorney, Agent, or Firm*—Mason, Kolehmainen, Rathburn & Wyss

[57] ABSTRACT

A modular cutter assembly for an electric dry shaver of the type wherein movable cutter assemblies are disposed in shearing relationship with a flexible comb assembly. Each of the cutter assemblies is easily removable or replaceable as a modular unit from the cutter drive shafts of the shaver head. The modular cutter assemblies are assembled by the insertion of alternating cutter blade element assemblies and cutter blade spacers within a cutter support structure with a predetermined interrelationship and orientation of the aforementioned subassembly parts to achieve a consistently and accurately disposed cutter system.

Each of the plurality of cutting blade element assemblies of each cutter assembly of the shaver is formed by two individual cutter blades having oppositely inclined outwardly angled cutting edges providing a desirable cutting edge geometry in a back-to-back relationship heretofore achievable only by the undercut grinding in two inclined directions of a single cutter blade or by coining to achieve a similar configuration. The two back-to-back individual cutter blades utilized to form the single cutter blade element assembly of each cutter assembly are fabricated as identical parts and mounted in a back-to-back reverse orientation to thereby achieve the oppositely inclined outwardly angled edges of the cutter blade pair. The individual cutter blades are fabricated with integrally formed biasing members which urge the cutter blade edges into accurate conformance with the comb assembly and establish a uniform consistent biasing force during operation.

21 Claims, 14 Drawing Figures

Fig. 1
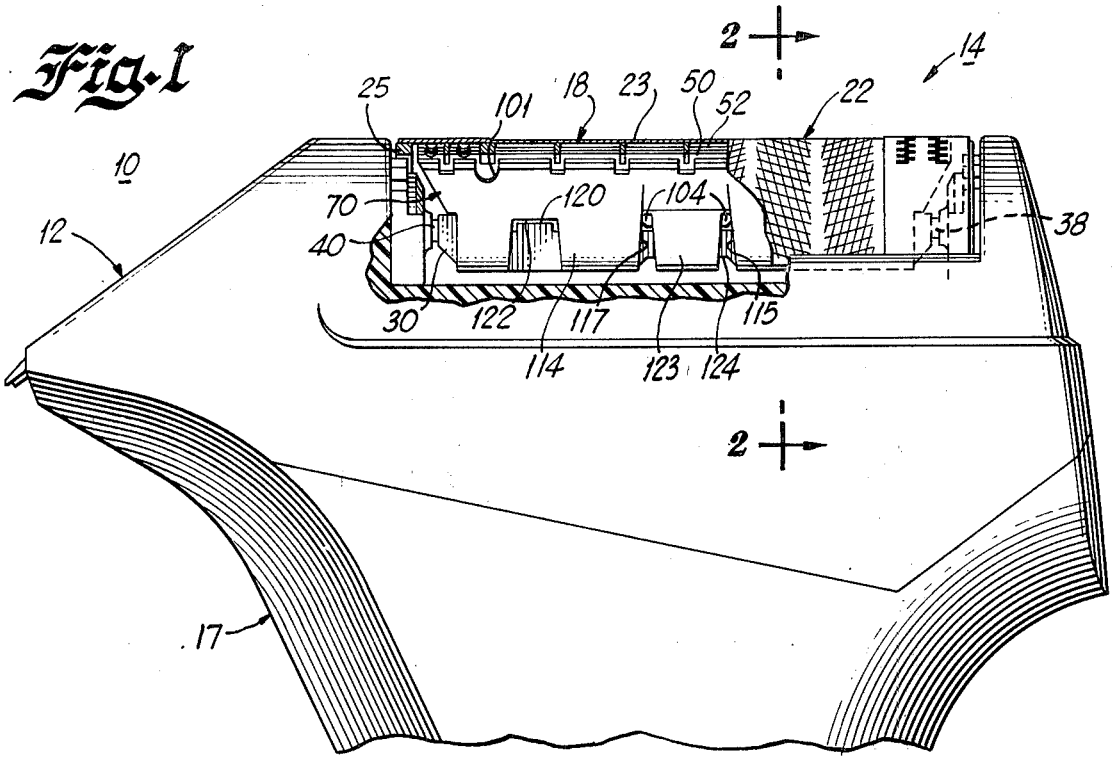
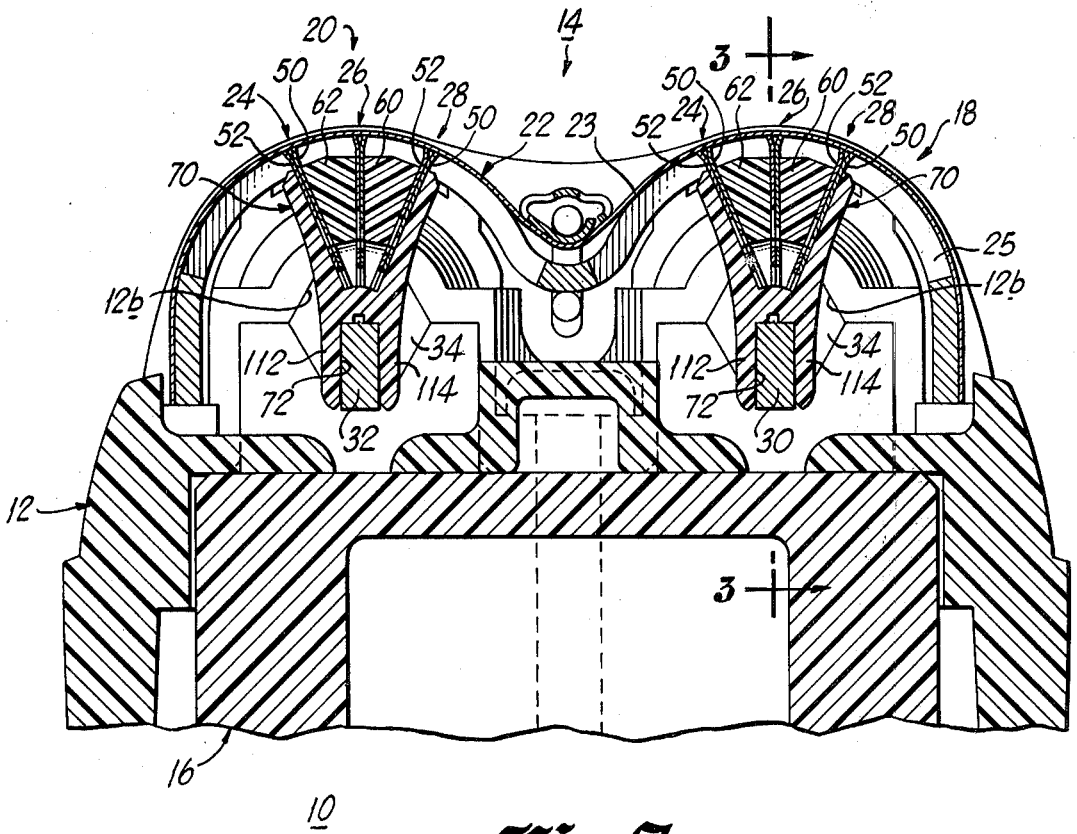
Fig. 2

MODULAR CUTTER ASSEMBLY FOR AN ELECTRIC DRY SHAVER

BACKGROUND OF THE INVENTION

A. Field of the Invention

The present invention relates generally to an electric dry shaver and more specifically to a new cutter assembly for attachment to the cutter drive mechanism of the shaver. The cutter assembly is fabricated as a modular assembly and positioned in the shaver head on the cutter drive mechanism as an assembled modular unit. The cutter assembly is assembled by the interfitting of a number of cutter blade elements and blade spacers in a predetermined interrelationship in a cutter support member.

B. Description of the Prior Art

In the electric dry shaver field, there are various types of shaving heads. One type of shaver in extensive use utilizes shearing elements formed by the interaction of oscillating or movable cutter assemblies with a stationary comb structure.

For example, the following U.S. patents describe cutter assemblies of this type: U.S. Pat. No. 3,791,030 which issued to Jackson, et al. on Feb. 12, 1974; No. 3,590,482 which issued to F. L. Carr on July 6, 1971; No. 3,401,453 which issued to C. L. Bauer on Sept. 17, 1968; No. 3,349,263 which issued to Jepson, et al. on Oct. 24, 1967; No. 3,196,539 which issued to Jepson, et al. on July 27, 1965; No. 3,208,141 which issued to Jepson, et al. on Sept. 28, 1965; and No. 2,688,184 which issued to Jepson, et al. on Sept. 7, 1954.

The cutter assemblies in the above referenced U.S. Patents are typically assembled by the insertion or attachment of individual cutting blades into supporting structure affixed to the movable cutter shafts in the shaving head.

For example, in Bauer U.S. Pat. No. 3,401,453, the individual cutting blade elements are inserted into various slotted portions of a blade support frame secured to the cutter shafts. Individual spring arms or levers are provided and extend from the blade support to provide the spring biasing of the cutter blades when individually inserted.

Another cutter assembly of this general type described in Jepson, et al. U.S. Pat. No. 3,208,141 includes integrally formed and downwardly depending hook shaped portions on the individual cutter blades for engaging and locking around triangular shaped, spaced blade support members. The blade support members are rigidly fastened to the cutter shaft by the passage of the cutter shaft through a circular opening in the support. The support includes spaced, slotted members; one for each of the cutting blade members. The depending hooked portions of each of the cutter blades are interlocked around additional slotted portions of the blade supports. Elongated wire spring members are disposed between the support members and the bottom of each of the blades to resiliently support the cutter blades.

While these types of cutter assemblies described hereinbefore are generally suitable for their intended use and application, the manufacturing assembly steps and the replacement of the individual cutter blades and the cutter assemblies in the field by service personnel and customers is relatively complex and costly.

Further, the inconsistency in the positioning and the repositioning during replacement of the cutter blades, springs and cutter support members results in increased lapping time during manufacture, the requirement for thicker comb structures and the necessity for frequent cleaning. The cleaning is made difficult by the many slots and open portions of the cutter assemblies exposed to the hairs falling through the comb assembly as shaving takes place. The cleaning tools may also deform or displace the various spring structures and subassembly parts altering the characteristics of the component parts.

SUMMARY OF THE INVENTION

It is, therefore, a primary object of the present invention to provide a new and improved cutter assembly which avoids one or more of the above-described disadvantages of the prior art arrangements.

It is another object of the present invention to provide a modular cutter assembly for a dry electric shaver that provides increased efficiency in the manufacturing and assembly of the cutter assembly and more consistent positioning of the cutter assembly and its component parts during initial manufacturing and replacement.

It is a further object of the present invention to provide a modular cutter assembly exhibiting simplified cleaning and maintenance of the cutter assembly wherein the cleaning operation does not disturb the positioning or consistent biasing and resilient support of the cutter blade elements within the modular cutter assembly.

It is yet another object of the present invention to provide a modular cutter assembly that allows the use of a cooperating comb assembly of the shaver having an optimum thickness for shaving characteristics.

It is a further object of the present invention to provide a cutter blade assembly which is assembled in modular form and inserted and attached to the cutter shaft of a shaver as a precisely positioned modular assembly wherein the cutter blade elements of the modular cutter assembly exhibit a consistent and accurately predetermined resilient biasing force.

It is another object of the present invention to provide a cutter assembly for an electric dry shaver wherein the biasing arrangement for resiliently supporting and urging the cutter blades in shearing relationship with the cooperating comb assembly is integrally formed with the individual cutter blade elements.

Another object of the present invention is a cutter assembly for an electric dry shaver which is assembled as a modular unit prior to installation in the shaver; the assembly being accomplished by the insertion of alternating cutter blade element assemblies and cutter element spacers into a cutter support member with a predetermined relationship between the various parts being established upon insertion into the cutter support member.

It is another object of the present invention to provide a cutter assembly for an electric dry shaver which is modularly assembled and which utilizes at least two identical cutter blades to form each cutter blade element assembly; the identical cutter blades being assembled in a back-to-back reverse orientation and being formed with inclined outwardly angled cutting blade edges so as to form a cutter element having oppositely inclined, outwardly angled cutting edges without the necessity of an undercut grinding or coining operation.

It is yet another object of the present invention to provide a cutter assembly for an electric dry shaver wherein the consistent uniform biasing characteristics of the cutter blades of each cutter assembly against the comb of the shaver allows the use of an optimum thinner comb thickness and provides more rapid lapping procedures than heretofore possible with cutter assemblies of the prior art.

Briefly, in accordance with one aspect of the present invention, a modular cutter assembly is provided for an electric dry shaver of the type wherein movable cutter assemblies are disposed in shearing relationship with a flexible comb assembly. Each of the cutter assemblies is easily removable or replaceable as a modular unit from the cutter drive shaft of the shaver head. The modular cutter assemblies are assembled by the insertion of alternating cutter blade element assemblies and blade spacers within a cutter support structure with a predetermined interrelationship and orientation of the aforementioned subassembly parts to achieve a consistently, accurately disposed cutter system.

Each of the plurality of cutting blade element assemblies of each cutter assembly of the shaver is formed by two individual cutter blades having oppositely inclined outwardly angled cutting edges providing a desirable cutting edge geometry in a back-to-back relationship heretofore achievable only by the undercut grinding or coining in two inclined directions of a single cutter blade. The two back-to-back individual cutter blades utilized to form the single cutter blade element assembly of each cutter assembly are fabricated as identical parts by stamping and then forming the inclined blade edges. The identical cutter blades are mounted in pairs in a reverse orientation to thereby achieve the oppositely inclined outwardly angled edges of the cutter blade pair forming the cutter blade element assembly. The individual cutter blades are fabricated with integrally formed biasing members which urge the cutter blade edges into accurate conformance with the comb assembly and establish a uniform consistent biasing force during operation.

The invention both as to its organization and method of operation together with further objects and advantages thereof, will best be understood by reference to the following specification taken in conjunction with the accompanying drawings.

BRIEF DESCRIPTION OF THE DRAWINGS

For a better understanding of the invention, frequent reference will be made to the drawings wherein:

FIG. 1 is a fragmentary side elevational view of an electric dry shaver with certain parts cutaway utilizing the modular cutter assembly of the present invention;

FIG. 2 is an enlarged fragmentary sectional view of the shaver illustrating the details of the modular cutter assembly of the present invention taken along line 2—2 of FIG. 1;

FIG. 8 is an enlarged fragmentary bottom elevational view of the modular cutter assembly illustrating further structural and interrelationship details taken generally along and from line 8—8 of FIG. 3;

DESCRIPTION OF THE PREFERRED EMBODIMENT

Figure 3:
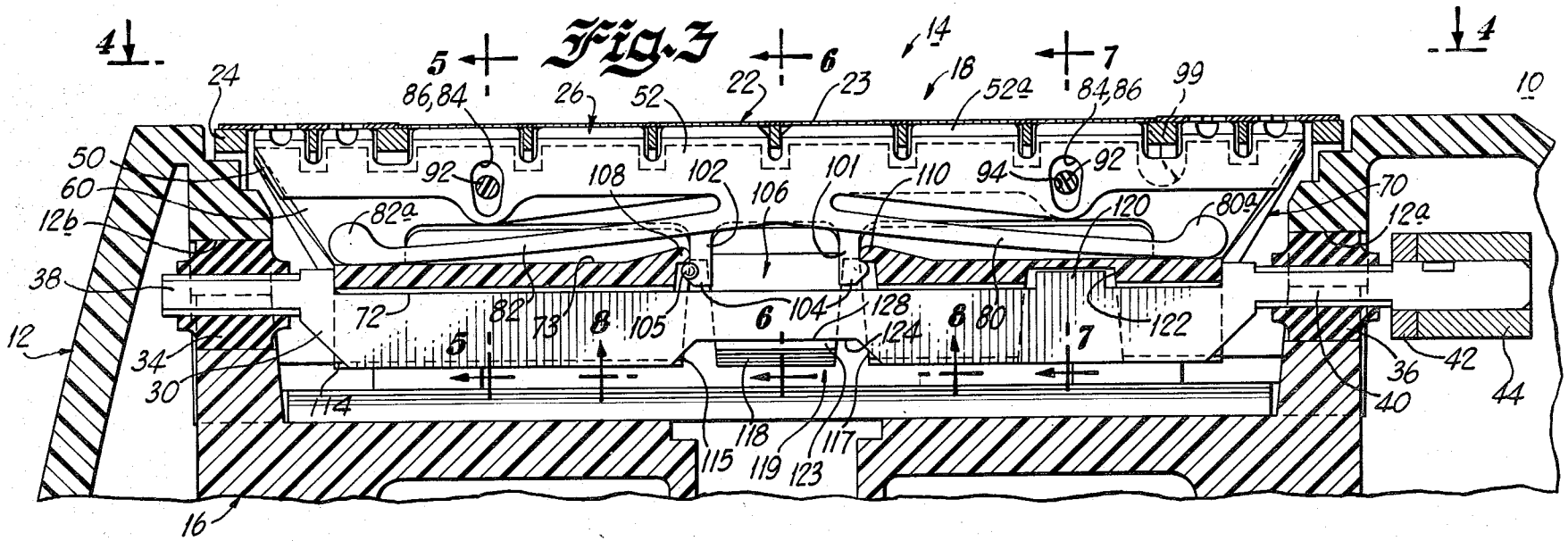
FIG. 3 is an enlarged fragmentary sectional view illustrating further details of the modular cutter assembly and the shaver head taken along line 3—3 of FIG. 2.

Referring to the drawings there is shown in FIGS. 1, 2 and 3 an electric dry shaver designated generally at 10 including an upper housing 12 on which is superimposed a shaving head assembly 14 and a lower chassis 16 onto which the housing 12 is mounted. A bottom cover 17 is mounted over the lower chassis 16 and interfits with the housing 12. As best seen in FIG. 2, the shaving head assembly 14 includes two shaving heads or shearing locations defined by the interaction of two cutter assemblies 18 and 20 with a comb assembly referred to generally at 22.

The comb assembly 22 includes a thin flexible comb panel 23 (FIG. 3) having perforations for the cutting of small hairs typically arranged throughout the central portion of the comb panel and long hair slotted portions or the like disposed along the end portions of the comb panel. The comb panel 23 is supported by and conforms to a comb support frame 25. The comb support frame 25 has a predetermined shape dependent upon shaver geometry; for example a double arched M-shape.

The cutter assemblies 18 and 20 in operation move in shearing engagement with the underside of the comb panel 23 and are driven by suitable drive mechanisms (not shown) which connect the cutter assemblies 18 and 20 to a motor (not shown) as well known in the art. The exact structure of the comb assembly 22 and associated drive mechanisms may be substantially as shown in the aforereferenced U.S. Pat. Nos. 3,791,030, 3,590,482, and 3,401,453 to which reference may be made for a more detailed description. In a specific embodiment, the comb assembly 22 may be of the type described in copending application Ser. No. 848,405 filed on Nov. 4, 1977 by W. P. Beck.

Figure 4:
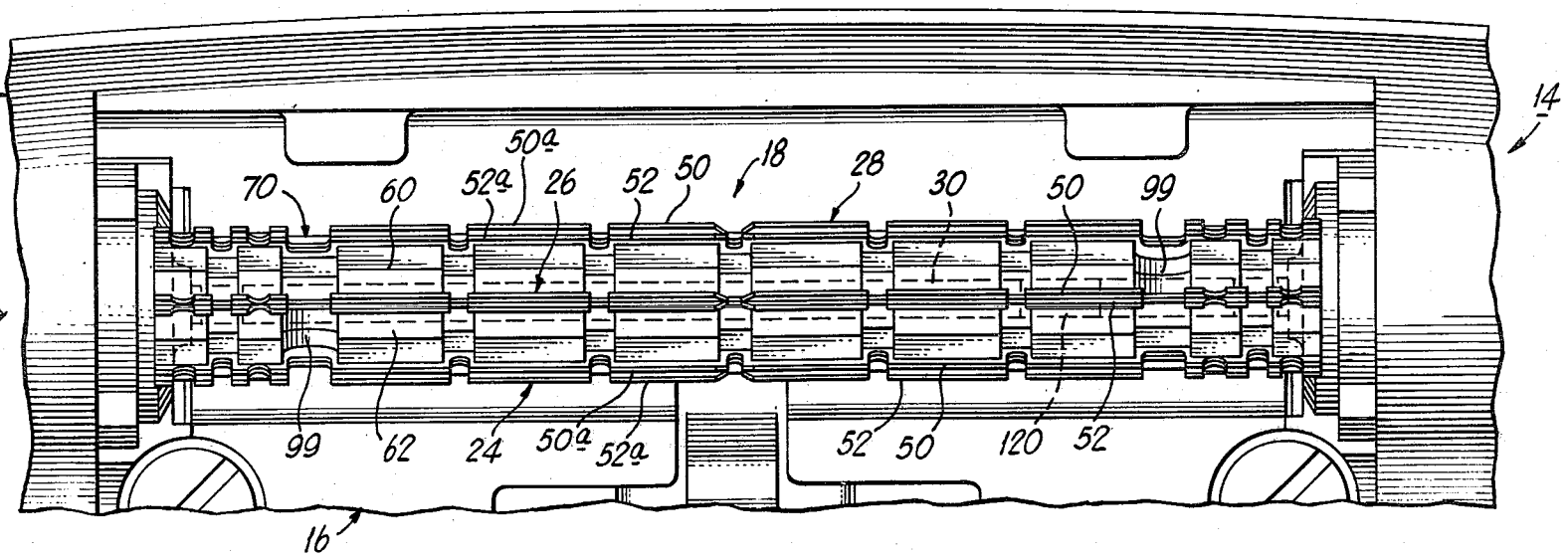
FIG. 4 is a top elevational view of a portion of the shaver head of FIGS. 1 and 2 illustrating an assembled modular cutter assembly.
Figure 14:
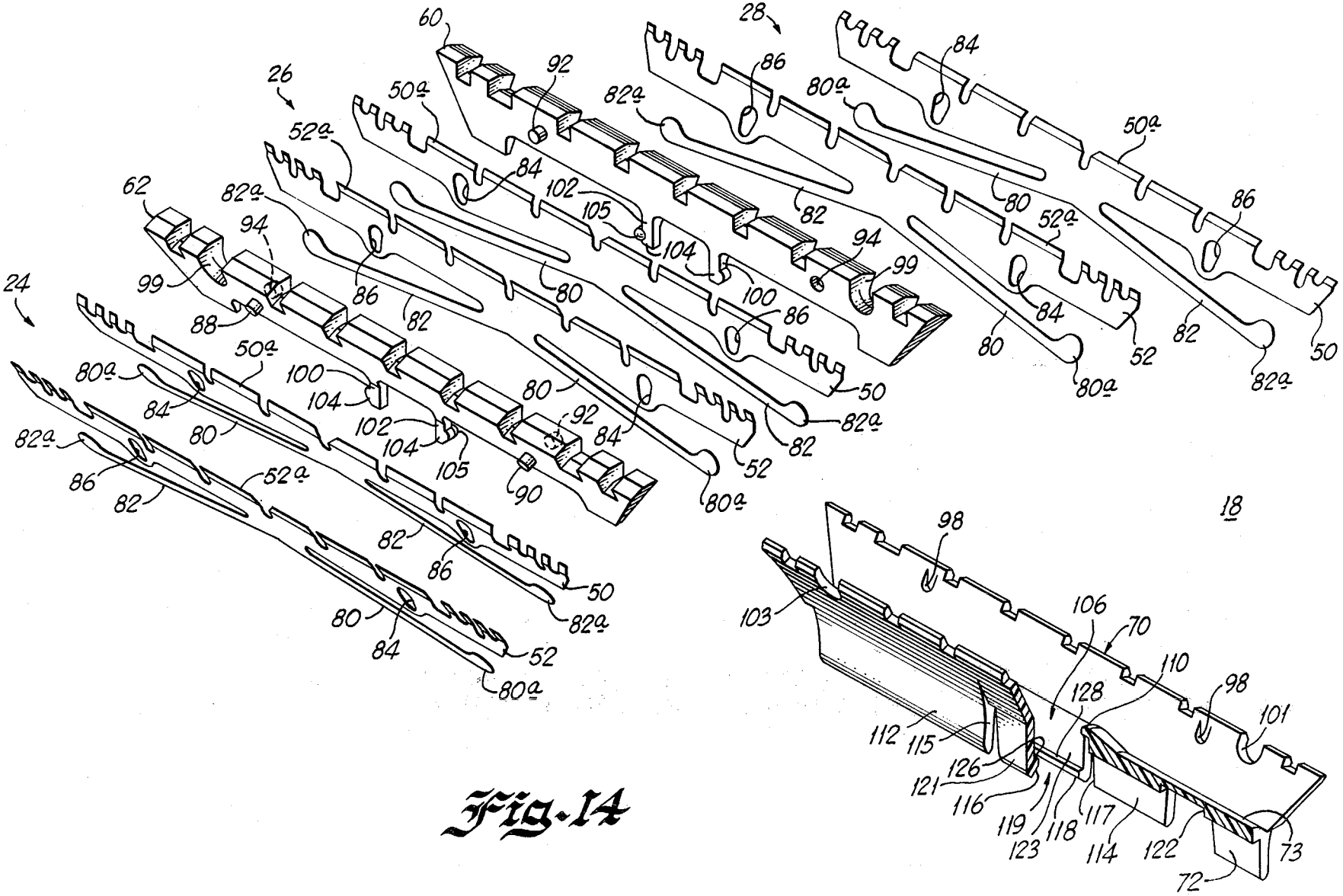
FIG. 14 is an exploded perspective view illustrating the interrelationship and assembly of the component parts of the modular cutter assembly.

In accordance with important aspects of the present invention and referring additionally now to FIGS. 4 and 14, each of the cutter assemblies 18 and 20 is fabricated as a modular unit and in an accurately, predetermined relationship. In a specific embodiment, each of the cutter assemblies 18 and 20 includes three cutter blade element assemblies 24, 26 and 28 assembled with predetermined orientations and upon assembly provided with a predetermined degree of side-to-side movement and a uniform, predetermined vertical resilient characteristic.

Each of the modular cutter assemblies 18 and 20 is inserted into the shaver head 14 by being positioned on and interfitted with a respective cutter drive shaft 30 and 32 of the shaver 10. Thus, field or customer replacement is much simplified with reduced probability of errors or misalignment.

The cutter drive shafts 30 and 32 each include two flexible housing bushings 34 and 36 molded onto respective narrowed end portions 38 and 40 of the cutter drive shafts 30 and 32 during fabrication. The cutter drive shafts 30 and 32 are rotatably mounted and supported within the housing 12 and the chassis 16 by the interfitting of the flexible bushings 34 and 36 with suitable housing and chassis bushing receptacle portions; the flexible bushings 34 and 36 being fixedly retained within the receptacle portion. On one end of each of the cutter drive shafts 32 and 34, an engaging portion 42 of a crank arm (not shown in detail) interfits with a cooperating extending portion 44 of the cutter drive shafts 30 and 32. Upon energization of the crank arm by the shaver motor, the drive shafts 30 and 32 are caused to reciprocate in a curved path describing an arc about the housing bushings 34 and 36.

Figures 5, 6, 7, 9:
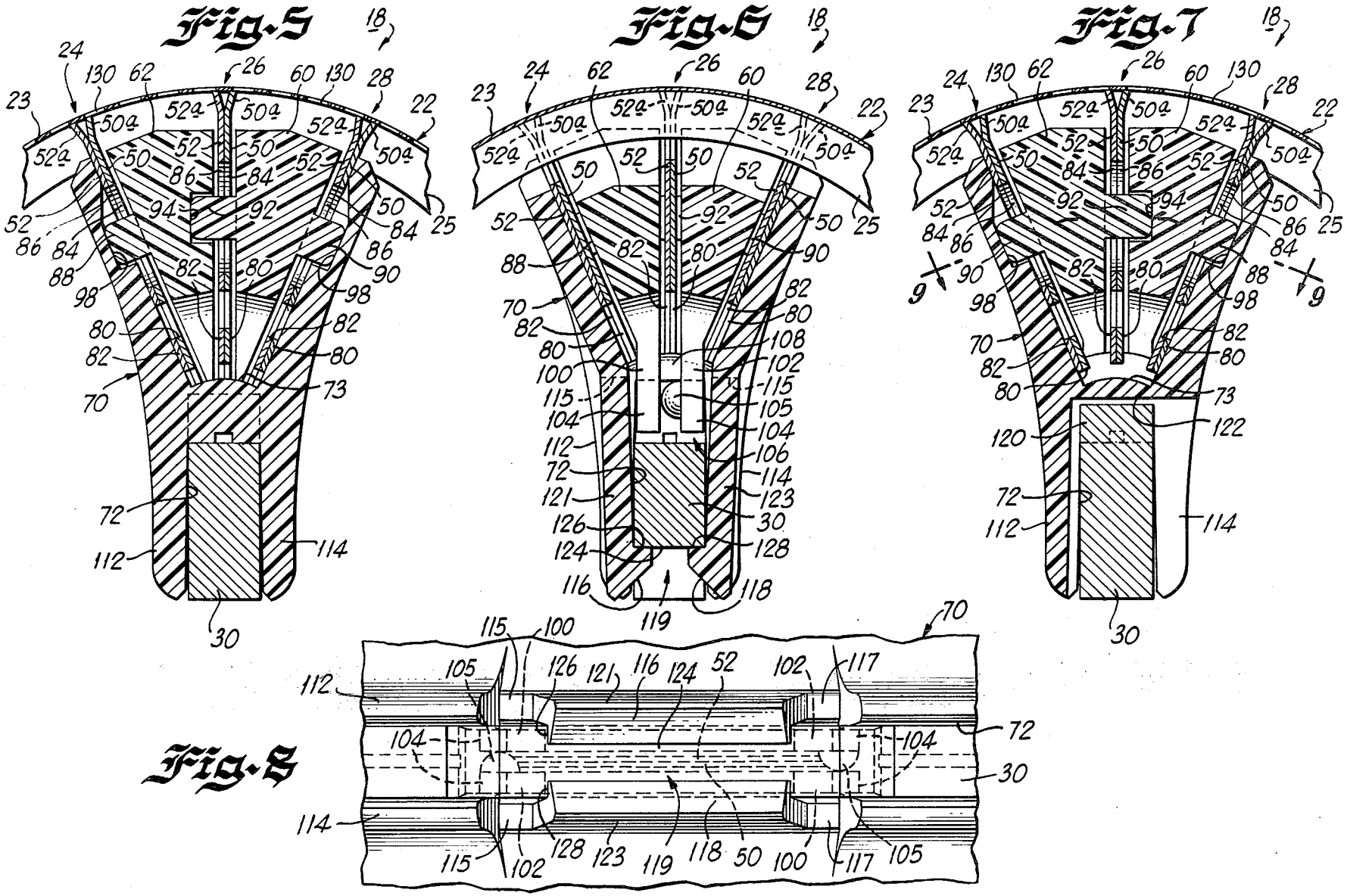
FIGS. 5, 6, and 7 are fragmentary, enlarged sectional views illustrating structural and operational details of the modular cutter assembly in shearing relationship with the shaver comb taken along lines 5—5, 6—6 and 7—7 of FIG. 3 respectively.
FIG. 9 is an enlarged sectional view of the modular cutter assembly taken along line 9—9 of FIG. 7.

In accordance with further important aspects of the present invention, each of the cutter blade element assemblies 24, 26 and 28 are formed, FIG. 5, by two individual cutting blades 50 and 52 having oppositely inclined and outwardly angled cutting edges 50*a* and 52*a* respectively providing a cutting edge geometry heretofore typically obtained by the undercut grinding or coining in two inclined directions of a single cutter blade.

The two individual cutter blades 50 and 52 utilized to form each of the single cutter blade element assemblies 24, 26 and 28 are fabricated as identical parts by a stamping operation followed by the forming of the inclined cutting edges 50*a* and 52*a* respectively. In a specific embodiment, the angle formed by each of the inclined blade edges is approximately 15°. The individual cutter blades 50 and 52, FIG. 14, are then assembled in a back-to-back, reverse orientation thereby achieving the oppositely inclined outwardly angled edges of the cutter blade element assemblies 24, 26 and 28.

In a specific preferred embodiment, three pairs of individual cutter blades 50 and 52 are assembled corresponding to the cutter blade element assemblies 24, 26 and 28 respectively. The modular cutter assemblies 18 and 20 further includes two cutter spacers 60 and 62 positioned intermediate the cutter assemblies 28 and 26 and the cutter assemblies 26 and 24 respectively. The cutter spacers 60 and 62 are identical and have a generally triangular wedge-shaped cross-section and include integrally formed structure for providing predetermined spacing, predetermined orientation and predetermined limited movement of the cutter blade element assemblies 24, 26 and 28 when interfitted and further assembled with a generally open, trough shaped cutter support member 70. Although three cutter blade element assemblies 24, 26 and 28 cooperating with two cutter spacers 60 and 62 are discussed in connection with a specific preferred embodiment, it should be realized that other combinations including various numbers of cutter blade element assemblies and cutter spacers are also contemplated by the present invention wherein a cutter spacer is provided between adjacent cutter blade element assemblies.

The cutter support member 70 of each of the modular cutter assemblies 18 and 20 is integrally fabricated with a receiving channel 72 formed below the base 73 of the generally trough shaped structure to interfit with the cutter shafts 30 and 32.

In accordance with yet other important aspects of the present invention, the identical cutter blades 50 and 52 are stamped or otherwise suitably fabricated with integral biasing leg members 80 and 82 to provide each of the blade assemblies 24, 26 and 28 of the cutter modular assemblies 18 and 20 with a predetermined and consistent biasing force against the underside of the comb panel 23 when installed on one of the cutter drive shafts 30 and 32 of the shaver 10.

In one specific embodiment, the biasing leg members 80 and 82 are elongated, inclined legs originating near the center of each of the cutter blades 50 and 52, extending downwardly and outwardly and terminating in respective curved foot portions 80*a* and 82*a* near the ends of each of the cutter blades. It should be understood, however, that in alternative specific embodiments, various geometric configurations are contemplated resulting in various predetermined resilient characteristics in response to a force applied to the cutting edges 50*a* and 52*a* with respect to the bottom or feet portions 80*a* and 82*a* of the respective cutter blades 50 and 52. Further, the biasing leg members may be shaped non-symmetrically with respect to each other for identification and orientation purposes.

When the assembled modular cutter assemblies 18 and 20 are attached to the respective cutter drive shafts 30 and 32, the comb assembly 22 is positioned and secured onto the housing 12 in a predetermined relationship with respect to the cutter assemblies 18 and 20. Thus, the shearing relationship to accomplish shaving is determined by the aforementioned positioning of the underside of the comb panel 23 in contact with the respective cutting edges 50*a* and 52*a* of the cutter blade assemblies 24, 26 and 28 at each shearing location. The resiliently disposed cutter blades 50 and 52 upon contact with the comb panel 23 are displaced downwardly in their respective cutter supports 70 by the deformation of the biasing leg members 80 and 82 and exert a uniform biasing force against the comb panel 23.

In this regard, the individual cutter blades 50 and 52 are fabricated with elongated guiding slots 84 and 86 which interfit with corresponding projecting pins 88 and 90 integrally formed on one side of the cutter spacers 60 and 62. Thus, when the cutter blades 50 and 52 are assembled into the modular cutter assemblies 18 and 20, the cutter blades 50 and 52 have a predetermined range of movement in a vertical direction determined by the resilient characteristics of the biasing leg members 80 and 82 and the relative dimensions of the elongated slots 84 and 86 and the pins 88 and 90.

The cutter spacers 60 and 62, cutter blades 50 and 52, and the cutter support 70 are fabricated along their top edges with predetermined patterns of slotted portions to allow for the positioning of the various cutting edges 50*a* and 52*a* of the modular cutter assemblies 18 and 20 into appropriate predetermined contact with the underside of the comb panel 23 while providing clearance for the structure of the comb support frame 25 depending downwardly from the undersurface of the comb panel 23.

Considering now the cutter spacers 60 and 62 in more detail, and referring to FIGS. 5, 6, 7, 11 and 14, the identical cutter spacers 60 and 62 are also arranged in a reverse, back-to-back relationship when assembled in the modular cutter assemblies 18 and 20. The cutter spacers 60 and 62 as discussed hereinbefore include the projecting pins 88 and 90 along one sidewall. The opposite sidewall of each of the cutter spacers 60 and 62 is fabricated with one projecting pin 92 opposite the pin 90 and one receiving socket 94 opposite the pin 88 which is disposed and dimensioned to accept an inserted projecting pin 92 from an adjacent cutter spacer.

Considering the cutter blade element assembly 28 in the assembled relationship of the modular cutter assembly 18 (FIG. 7), the pin 88 of the cutter spacer 60 projects through the slot 84 of the cutter blades 52 and the slot 86 of the cutter blade 50. Further, the pin 88 of the cutter spacer 60 interfits with a groove 98 formed on the inside of the sidewall of the cutter support 70. On the opposite sidewall surface of the cutter spacer 60, the socket 94 accepts the projecting pin 92 of the adjacent cutter spacer 62 extending through the slot 84 of the cutter blade 52 and the slot 86 of the cutter blade 50 of the cutter blade element assembly 26.

Similarly, as shown in FIG. 5, at the opposite end of each of the cutter spacers 60 and 62, the pin 90 of the cutter spacer 60 projects through the slot 86 of the cutter blade 52 and the slot 84 of the cutter blade 50 and interfits with another groove 98 of the cutter support 70. On the opposite side of the cutter spacer 60, the pin 92 projects through the slot 84 of the cutter blade 50 and the slot 86 of the cutter blade 52 and interfits with the socket 94 of the cutter spacer 62. On the opposite surface of the cutter spacer 62, the pin 88 extends through the slot 84 of the cutter blade 50 and the slot 86 of the cutter blade 52 and interfits with a corresponding groove 98 of the cutter support 70.

Similarly to the cutter spacer 60, the cutter spacer 62 at the opposite end (FIG. 7) includes a pin 90 extending through the slot 86 of the cutter blade 50 and the slot 84 of the cutter blade 52 and interfits with another groove 98 of the cutter spacer 70. On the opposite side of the cutter spacer 62, the pin 92 extends through the slots 84 and 86 of the cutter blades 52 and 50 respectively of the cutter blade element assembly 26 and interfits with the socket 94 of the cutter spacer 60.

The pins 88, 90 and 92 projecting through respective slots 84 and 86 and interfitting with their respective sockets 94 and the grooves 98 provide the predetermined range of vertical movement for the various blades 50 and 52. Further, the pins 88, 90 and 92 cooperating with respective sockets 94 and grooves 98 also provide for the proper orientation and support of the cutter spacers 60 and 62 and the cutter blade element assemblies 24, 26 and 28 within the cutter support 70.

In accordance with an important aspect of the present invention, the pins 88, 90 and 92 in combination with respective slots 94 and grooves 98 provide a predetermined degree of side-to-side movement of the cutter blade element assemblies 24, 26 and 28. The degree of movement is determined by the length of the projection of the pins 88, 90 and 92 from their respective cutter supports 60 and 62 relative to the thickness of the cutter blades 50 and 52 and the depth of the sockets 94 and grooves 98.

To assemble each of the modular cutter assemblies 18 and 20 (FIG. 14), the three cutter blade element assemblies 24, 26 and 28 each formed by the combination of two cutter blades 50 and 52 in a reverse orientation are first assembled with the cutter spacers 60 and 62 as described hereinbefore. The assembly of alternating cutter blade element assemblies 24, 26 and 28 and the cutter spacers 60 and 62 in the relationship as illustrated in FIG. 14 and described hereinbefore is then inserted as a subassembly module into the cutter support 70.

To aid assembly of the modular cutter assemblies 18 and 20, the proper orientation of the cutter spacers 60 and 62 with respect to the cutter support 70 are identified by the provision of identifiably shaped slotted portions along the top edges in a specific embodiment coinciding with one of the comb frame clearance slots. For example, each of the identical cutter spacers 60 and 62 is formed with a semicircular slotted portion 99 near one end for alignment during assembly with two corresponding semicircular slotted portions 101 and 103 formed in opposite sidewalls and at opposite ends in the cutter support 70.

Figures 9, 10, 11, 12, 13:
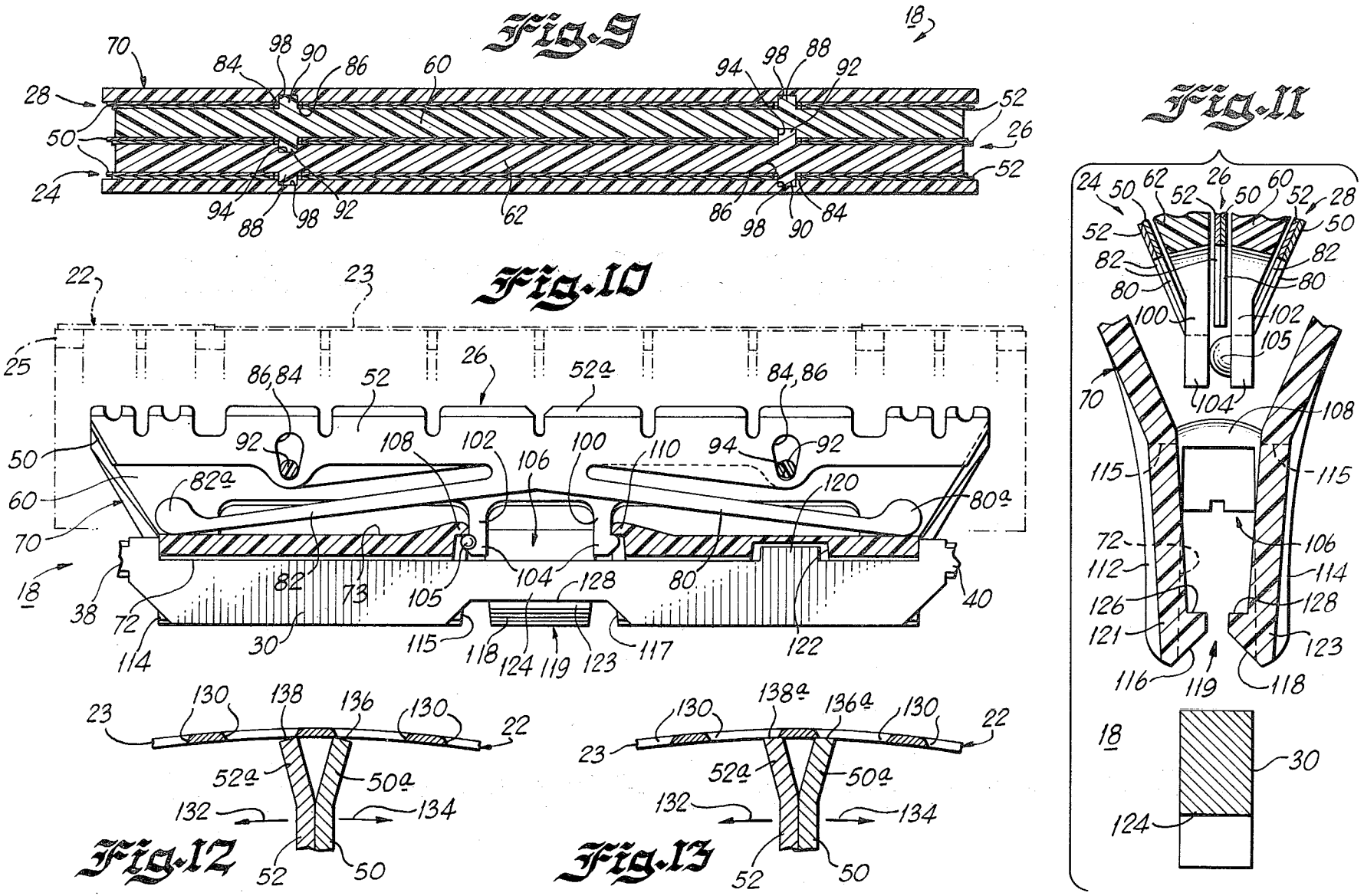
FIG. 10 is a front elevational view partly in section of the shaving head and modular cutter assembly of FIG. 3 with parts removed for clarity and representing the shaver comb in a raised portion.
FIG. 11 is an exploded view partly in section of the modular cutter assembly of FIG. 6.
FIGS. 12 and 13 are diagrammatic representations of the shearing relationship of the cutter blade edges and the shaver comb illustrating the details of the blade cutting edges relative to the shaver comb before and after a lapping operation.

In accordance with another important aspect of the present invention and referring additionally now to FIG. 10, the cutter spacers 60 and 62 are each fabricated with a pair of spaced legs 100 and 102 extending downward from the bottom of the cutter spacers 60 and 62. Each of the legs 100 and 102 includes a curved foot extension 104 outwardly disposed toward the ends of the cutter spacers 60 and 62. The leg 102 of each of the cutter spacers 60 and 62 further includes a hemispherical projection 105 for providing a predetermined assembly spacing and orientation of the cutter spacers within the cutter support 70 as best seen in FIG. 8.

The spaced legs 100 and 102 upon insertion into the cutter support 70 are deformed toward each other as they pass through a central passageway 106 in the base 73 of the cutter support 70. Upon full insertion, the legs 100 and 102 pass through the base of the cutter support 70 and lock along the bottom surface of the base 73 in the channel 72. The feet 104 contact and interfit with two ledges 108 and 110 (FIG. 10) of the base 73 and projecting along the length of the channel 72 into the central passageway 106.

In accordance with other important aspects of the present invention to retain and secure the modular cutter assemblies 18 and 20 to the respective cutter shafts 30 and 32, the sidewalls 112 and 114 of the cutter support 70 forming the receiving channel 72 in the area of the central opening 106 each include a sloped surface or ramp 116 and 118 respectively defining a sloping narrowed entryway 119 throughout a predetermined central portion of the receiving channel 72. The sidewalls 112 and 114 each include two slots 115 and 117 defining sidewall portions 121 and 123 respectively at the ends of each of the ramps 116 and 118 to provide a flexing or retaining clip characteristic to the sidewall portions 121 and 123.

The cutter shafts 30 and 32 are also fabricated with a narrowed height portion 124 disposed approximately midway along the cutter shafts for cooperation with the narrowed entryway 119. Upon assembly of the cutter support 70 onto the cutter shafts 30 and 32, the sidewall portions or clips 121 and 123 are first deformed about and then lock or interfit around the bottom of the narrowed cutter shaft portion 124.

A keyed extension tab 120 is formed at one point of each of the cutter shafts 30 and 32 and a mating correspondingly disposed slot 122 is formed in the cutter support 70 for restricting the assembly of the modular cutter assemblies 18 and 20 onto the respective cutter shafts 30 and 32 in a predetermined orientation. The sidewall portions or clips 121 and 123 thus fit on opposite sides of the narrowed height portion 124, which is generally rectangular in cross-section as shown in FIG. 6, and respective extensions of the sidewall portions or clips 121 and 123 thus lock around respective corners formed by these sides and another side of the narrowed height portion 124 as indicated at 126 and 128 respectively in FIG. 6.

In accordance with an important aspect of the present invention and considering the assembled modular cutter assemblies 18 and 20, the integrally formed biasing leg members 80 and 82 on each of the cutting blades 50 and 52 are entirely disposed within the interior of the modular cutter assemblies 18 and 20. The biasing leg members 80 and 82 of the various cutter blades 50 and 52 are surrounded by the interior surfaces of the cutter support 70 and the cutter spacers 60 and 62.

Thus, the uniform and consistent biasing characteristics established by the biasing leg members 80 and 82 is preserved despite the reassembly or replacement of the modular cutter assemblies 18 and 20. Further, the biasing characteristics are unaffected by cleaning operations wherein cleaning tools or brushes are capable of deforming exposed biasing structures of conventional shavers.

The displacement of the biasing leg members 80 and 82 and thus the cutting edges 50*a* and 52*a* is illustrated in FIGS. 3 and 10. In FIG. 3, the comb panel 23 is in contact with the cutter blades 50 and 52 thereby deforming the biasing leg members 80 and 82 and establishing the predetermined urging force against the comb panel 23 in accordance with the spring characteristic of the biasing leg members 80 and 82. In FIG. 10, the comb panel 23 is in a raised position and thus there is essentially no biasing force exterted by the cutter blades 50 and 52 against the comb panel 23. The displacement in FIG. 3 is illustrated by the relative position, approximately midway, of the pins 92 within the slots 84 and 86 compared to the position of the pins 92 in FIG. 10 at the bottom of the slots 84 and 86.

Referring now to FIGS. 12 and 13, the shearing relationship of the outwardly angled cutting edges 50*a* and 50*b* of the cutter blades 50 and 52 respectively are diagrammatically illustrated in engagement with the underside surface of the comb panel 23 with representative small hair holes or perforations 130. The oscillatory movement of the cutter blades 50 and 52 are described by the arrows 132 and 134 in the form of an arc or curvilinear path in engagement with the underside of the comb panel 23.

In FIG. 12, the squared-off right angled top surfaces 136 and 138 of the respective opposed outwardly angled cutting edges 50*a* and 52*a* illustrate the orientation and geometry prior to the final lapping-in process. In FIG. 13, the top surfaces 136*a* and 138*a* of the cutting edges 50*a* and 52*a* respectively are illustrated after the lapping procedure wherein the surfaces 136 and 138 have been ground away resulting in conformance with the curved underside of the comb assembly 22.

Since the thickness of each of the cutter blades 50 and 52 is considerably less than conventional single cutter blades, the cutting edge surfaces 136 and 138 that determine the extent of lapping are also reduced. Thus, the lapping-in procedure is much reduced in time and achieves a better conformance of the blade edges 136 and 138 to the comb panel 23 due to the forming of the cutter blade element assemblies 24, 26 and 28 by the back-to-back reverse orientation of the two identical cutter blades 50 and 52.

Further, since thinner stock is utilized to fabricate the cutter blades 50 and 52 than conventional single cutter blade elements, the cutting edges 50*a* and 52*a* are more flexible and more readily conform to the shape of the comb panel 23. Consequently, the result is a more uniformly controlled manufacturing process and less variation in the thickness of the comb panel 23 in the final lapped-in assembled shaver. The thickness of the comb is very important in achieving satisfactory shaving conditions. Thus, it is highly desirable to maintain the finished thickness within a narrow range. If the comb is greater than a first predetermined thickness, a satisfactory shave will not be obtained. On the other hand, if the comb thickness is below a second predetermined thickness, denting and early failure, i.e. reduced life, of the comb will result.

Further, the more uniform and consistent biasing force, i.e. resilient force characteristic, exhibited by the modular cutter assemblies 18 and 20 and obtained by the integrally formed biasing leg members 80 and 82, decreases the variation in the final comb thickness after the lap-in procedure.

Obviously, many modifications and variations of the present invention are possible in light of the above teachings.

For example, the number of modular cutter assemblies 18 and 20 as well as the number of cutter blade element assemblies 24, 26 and 28 and the number of corresponding cutter spacers 60 and 62 to form each modular cutter assembly may be varied. It is contemplated that cutter spacers may be provided in addition to the single cutter spacers between adjacent cutter blade element assemblies. Also, in a specific embodiment, the cutter spacers 60 and 62 are fabricated as a single interconnected assembly in the form of a bellows arrangement. Further, the number of blades 50 and 52 utilized to form a blade element assembly may also be varied. It is also contemplated that integral biasing members 80 and 82 of various shapes and inclinations may be utilized according to the requirements for various predetermined resilient characteristics of the modular cutter assemblies 18 and 20. The shape and orientation of the integrally formed pins 88, 90 and 92, the sockets 94, the slots 84 and 86 and the grooves 98 utilized as the spacing, orientating and vertical movement determining structure of the modular cutter assemblies may be varied while still achieving the same overall characteristics of the modular cutter assemblies 18 and 20.

Thus, it is to be understood that, within the scope of the appended claims, the invention may be practiced otherwise than as specifically described.

What is claimed and desired to be secured by Letters Patent of the United States is:

1. A modular cutter assembly for insertion as a modular unit into an electric dry shaver having at least one cutter drive shaft rotatably mounted within said electric dry shaver and having a comb assembly disposed in shearing engagement with the inserted cutter assembly, said modular cutter assembly comprising:

at least two cutter blade elements:

means disposed intermediate adjacent cutter blade elements and interfitting with said cutter blade elements for spacing said cutter blade elements in a predetermined manner; and means for retaining said cutter blade elements and said cutter blade element spacing means in a predetermined orientation, said retaining means comprising means interfitting with said cutter drive shaft upon insertion of said modular cutter assembly as a modular unit into said electric dry shaver, thus securing said modular cutter assembly to said cutter drive shaft, and thus enabling said modular cutter assembly to be removed from said cutter drive shaft and replaced as a modular unit while said cutter drive shaft remains rotatably mounted within said electric dry shaver.

2. The modular cutter assembly of claim 1 wherein said cutter drive shaft has a portion which is non-circular in cross-section and with which said last-mentioned means interfits upon insertion of said modular cutter assembly as a modular unit into said electric dry shaver.

3. The modular cutter assembly of claim 2 wherein said portion of said cutter drive shaft is generally rectangular in cross-section and wherein said last-mentioned means has sidewall portions which fit on opposite sides of said portion of said cutter drive shaft.

4. The modular cutter assembly of claim 3 wherein said sidewall portions have respective extensions which lock around respective corners formed by said sides and another side of said portion of said cutter drive shaft.

5. A modular cutter assembly for insertion into an electric dry shaver having at least one movable cutter drive mechanism and a comb assembly comprising a cylindrical comb disposed in shearing engagement with the inserted cutter assembly, said modular cutter assembly comprising:

at least two cutter blade elements mounted for oscillatory rotation about the axis of the comb whereby sharpened portions of said modular cutter assembly engage the curved underside of said comb;

means disposed intermediate adjacent cutter blade elements and interfitting with said cutter blade elements for spacing said cutter blade elements in a predetermined manner; and means for retaining said cutter blade elements and said cutter blade element spacing means in a predetermined orientation, said retaining means comprising means interfitting with said cutter drive mechanism for securing said modular cutter assembly to said cutter drive mechanism:

wherein said cutter blade elements are each formed by assembling two cutter blades which are identical and formed as separate parts; and wherein each blade is thin, flexible, and planar except for a cutting edge portion which is inclined at an acute angle with respect to the planar portions of such blade, the blades being assembled so that said planar portions are disposed in a back-to-back relationship with respect to each other and so that the cutting edge portions are inclined in opposite directions with respect to each other, each cutting edge portion having a sharpened cutting edge in substantial conformance with the curved underside of said comb.

6. The modular cutter assembly of claim 5 wherein each blade has a front facing the direction in which its cutting edge portion is inclined and a back facing oppositely and wherein each sharpened cutting edge defines an acute angle comprising the front of the blade having such sharpened cutting edge and also comprising a surface left after removal of material from the back of said blade.

7. The modular cutter assembly of claim 6 wherein the cutting edge portion of each blade is inclined at an angle of approximately 15° with respect to the planar portions of such blade.

8. The modular cutter assembly of claim 5 wherein the cutting edge portion of each blade is inclined at an angle of approximately 15° with respect to the planar portions of such blade.

9. A modular cutter assembly for insertion into an electric dry shaver having at least one movable cutter drive mechanism and a comb assembly disposed in shearing engagement with the inserted cutter assembly, said modular cutter assembly comprising:

at least two cutter blade elements;

means disposed intermediate adjacent cutter blade elements and interfitting with said cutter blade elements for spacing said cutter blade elements in a predetermined manner; and means for retaining said cutter blade elements and said cutter blade element spacing means in a predetermined orientation, said retaining means comprising means interfitting with said cutter drive mechanism for securing said modular cutter assembly to said cutter drive mechanism, said cutter blade element spacing means comprising integrally formed means for providing a predetermined range of movement of said cutter blade elements as measured along a line extending across said cutter blade element height in a direction in reaction to a force applied from said comb assembly, said predetermined range of movement providing means comprising at least two elongated slots in said cutter blade element and projections extending from said cutter blade element spacing means disposed for interfitting with respective ones of said elongated slots.

10. The modular cutter assembly of claim 9 wherein said predetermined range of movement is defined by the length of said elongated slots and the dimensions of said projections.

11. The modular cutter assembly of claim 9 wherein said projections determine said predetermined manner of spacing said cutter blade elements, the length of said projections and the thickness of said cutter blade elements determining the spacing of said cutter blade elements.

12. A modular cutter assembly for insertion into an electric dry shaver having at least one movable cutter drive mechanism and a comb assembly disposed in shearing engagement with the inserted cutter assembly, said modular cutter assembly comprising:

at least two cutter blade elements;

means disposed intermediate adjacent cutter blade elements and interfitting with said cutter blade elements for spacing said cutter blade elements in a predetermined manner; and means for retaining said cutter blade elements and said cutter blade element spacing means in a predetermined orientation, said retaining means comprising means interfitting with said cutter drive mechanism for securing said modular cutter assembly to said cutter drive mechanism, said retaining means being generally trough shaped and said cutter blade element spacing means comprising at least one elongated planar spacer element having a wedge shaped cross-section.

13. The modular cutter assembly of claim 12 further comprising means integrally formed on said cutter blade element spacing means and said retaining means for interlocking said cutter blade elements and said cutter blade element spacing means with said retaining means upon assembly of said modular cutter assembly.

14. The modular cutter assembly of claim 13 wherein said interlocking means comprises a pair of spaced legs each having a curved extending foot portion extending from the bottom of said spacer element, a passageway formed in the bottom surface of said trough shaped retaining means, and said trough shaped retaining means further including extending tabs disposed to interfit with respective ones of said feet upon insertion of said spacer element into said retaining means.

15. The modular cutter assembly of claim 14 wherein one of said legs comprises means extending in a direction generally perpendicular to the plane of said cutter blade element spacing means for maintaining a predetermined relationship between said spacer elements.

16. The modular cutter assembly of claim 12 wherein one spacer element is provided between each two adjacent cutter blade elements.

17. The modular cutter assembly of claim 12 wherein $n-1$ spacer elements are provided for n cutter blade elements, one spacer element being disposed between each two adjacent cutter blade elements.

18. In a cutter for a dry shaver having a cylindrical comb, the cutter being of a type to be mounted for oscillatory rotation about the axis of the comb whereby sharpened portions of the cutter engage the curved underside of the comb while the cutter oscillates so as to shear any hairs received by the comb, an improvement wherein the cutter comprises a pair of identical blades formed as separate parts, each blade being thin, flexible, and planar except for a cutting edge portion which is inclined at an acute angle with respect to the planar portions of such blade, the blades being assembled so that said planar portions are disposed in a back-to-back relationship with respect to each other and so that the cutting edge portions are inclined in opposite directions with respect to each other, each cutting edge portion having a sharpened cutting edge in substantial conformance with the curved underside of the comb with which the cutter is to cooperate.

19. The improvement of claim 18 wherein each blade has a front facing the direction in which its cutting edge portion is inclined and a back facing oppositely and wherein each sharpened cutting edge defines an acute angle comprising the front of the blade having such sharpened cutting edge and also comprising a surface left after removal of material from the back of said blade.

20. The improvement of claim 19 wherein the cutting edge portion of each blade is inclined at an angle of approximately 15° with respect to the planar portions of such blade.

21. The improvement of claim 18 wherein the cutting edge portion of each blade is inclined at an angle of approximately 15° with respect to the planar portions of such blade.

* * * * *